US005711914A

United States Patent [19]

Heller

[11] Patent Number: 5,711,914

[45] Date of Patent: Jan. 27, 1998

[54] RAIL STEEL

[75] Inventor: Wilhelm Heller, Duisburg, Germany

[73] Assignee: NMH Stahwerke GmbH, Sulzbach-Rosenberg, Germany

[21] Appl. No.: 341,833

[22] Filed: Nov. 18, 1994

Related U.S. Application Data

[63] Continuation of Ser. No. 138,239, Oct. 15, 1993, abandoned.

[30] Foreign Application Priority Data

Oct. 15, 1992 [DE] Germany ..... 42 34 815.3

[51] Int. Cl.[6] ..... C22C 38/60; C21D 8/00

[52] U.S. Cl. ..... 420/84; 420/110; 148/906; 148/584

[58] Field of Search ..... 420/84, 110, 111, 420/104; 148/581, 584

[56] References Cited

U.S. PATENT DOCUMENTS

| | | | |
|---|---|---|---|
| 4,032,333 | 6/1977 | Josefsson . | |
| 4,326,886 | 4/1982 | Abeyama et al. . | |
| 4,404,047 | 9/1983 | Wilks . | |
| 4,898,629 | 2/1990 | Lang et al. . | |
| 5,013,525 | 5/1991 | Hamada et al. | 148/906 |
| 5,077,003 | 12/1991 | Muraoka et al. | 148/906 |
| 5,085,733 | 2/1992 | Mitamura | 148/906 |

FOREIGN PATENT DOCUMENTS

| | | | |
|---|---|---|---|
| 57-39163 | 3/1982 | Japan | 420/84 |
| 60-145362 | 7/1985 | Japan | 420/84 |
| 60-248867 | 12/1985 | Japan | 420/84 |
| 61-130469 | 10/1986 | Japan . | |
| 62-205218 | 2/1988 | Japan . | |
| 63-109145 | 9/1988 | Japan . | |
| 3-44447 | 2/1991 | Japan . | |
| 4-154913 | 5/1992 | Japan . | |

*Primary Examiner*—Deborah Yee

*Attorney, Agent, or Firm*—Bell Seltzer; Intellectual Property Law Group of Alston & Bird LLP

[57] ABSTRACT

The properties of conventional steels for rails, check rails and railroad rolling components can be improved by small amounts of tellurium. This applies particularly to the wear resistance and the mechanical properties in the transverse direction and at oxygen contents of less than 0.0015% and sulfur contents up to 0.007%.

8 Claims, 2 Drawing Sheets

RAIL STEEL

This application is a continuation of application Ser. No. 08/138,239, filed Oct. 15, 1993, now abandoned.

TECHNICAL FIELD OF THE INVENTION

The invention relates to steels for rails, check rails and railroad rolling components such as wheel disks, tires and one-piece wheels.

BACKGROUND OF THE INVENTION

Steels of this kind are known with a variety of different compositions. They need to be weldable, and owing to the severe dynamic stresses in the wheel/rail system they require high yield strength, ultimate tensile strength and fatigue strength, resistance to fracture and stability of form. In addition, owing to the severe frictional stresses rail steels need to exhibit high wear resistance. For example, the life of rails subjected to the same mechanical stresses is determined essentially by the wear resistance and the wear volume initially present in the rail head. Under conditions that are otherwise the same the wear resistance of rails increases with higher strength. The strengths of 1100 or even 1200 $N/mm^2$ achievable at the present day are however at the expense of toughness, welding properties and resistance to fracture.

The known steels, normally unalloyed or at most alloyed with small amounts of manganese, chromium, vanadium and molybdenum, are used as-rolled, i.e. without heat treatment. They have a pearlitic or ferritic-pearlitic structure formed on air cooling and are described in the "Draft European Rails Standard," Part 1, December 1991 and March 1993 edition and contain 0.60 to 0.82% carbon, 0.13 to 0.60% silicon, 0.66 to 1.30% manganese, on average 0.02 to 0.03% phosphorus and 0.008 to 0.030% sulfur, balance iron and impurities. The tensile strength level of these steels is at least 800 to 1130 $N/mm^2$.

Tellurium-containing steels are also known. Thus U.S. Pat. No. 4,404,047 describes low-alloy steels with 0.042 and 0.045% tellurium in the context of a heat treatment process, without making clear the role of the tellurium. Furthermore German Offenlegungsschriften (published applications) 29 37 908, 30 09 491 and 30 18 537 disclose free-machining steel inter alia with up to 0.6% carbon, up to 0.5% or up to 2.5% silicon, up to 2.0% manganese, 0.003 to 0.04% or up to 0.40% sulfur and up to 0.03% tellurium, which may also contain considerable amounts of alloying ingredients. Here the tellurium serves to improve the cold workability.

OBJECT OF THE INVENTION

Proceeding from the state of the art, the object of the invention is to provide a steel having improved wear resistance and increased rupture strength and toughness without impaired welding properties.

SUMMARY OF THE INVENTION

The present invention is based on the discovery that not only in the case of rail steels the transverse properties, i.e. the technological properties transverse to the direction of rolling, exert a decisive influence on the life. The basis of this is the observation that under wear stress particles of material separate in the transverse direction, and that while the formation and propagation of cracks in the case of fatigue damage, for example shelling, run in the longitudinal direction it is the fatigue strength in the transverse direction that is decisive for this.

While it is known that in the case of rail steels the properties of the material depend in part on the position of the sample relative to the direction of rolling, this does not hold for tensile strength. Rather, the yield strength is somewhat higher transverse to the direction of rolling, while the elongation in the direction of rolling is about 50 to 60%, and the reduction in area on fracture about 65 to 75%, smaller than in the direction of rolling.

There has therefore been no lack of attempts to improve the transverse properties of rail steels. These attempts have however not led to success.

The invention shows a way by which the transverse properties of rail steels can be substantially improved by simple metallurgical means.

Thus tests have shown that tellurium raises the hot strength of the sulfides: in the presence of tellurium these do not yield on hot working but substantially retain their spherical-elliptical shape. Accordingly these sulfides give rise to a far smaller notch effect than occurs in the case of the usual sulfides, which yield in the direction of rolling on hot rolling. The consequence of this is not only better wear properties but also improvement of the transverse mechanical properties without the welding properties suffering.

The effect of the tellurium shows up in all known rail grades, irrespective of whether their structure is ferritic-pearlitic, pearlitic, fine-pearlitic, quenched and tempered or bainitic.

The steel of the invention therefore contains up to 0.004%, and preferably at least 0.00015 or 0.002%, tellurium and preferably less than 0.0015% oxygen and/or less than 0.007% sulfur. The wear properties are particularly good if the sulfur/tellurium ratio amounts to about 0.1 to 0.6.

DETAILED DESCRIPTION OF PREFERRED EMBODIMENT OF THE INVENTION

In addition to the specified amounts of tellurium and/or sulfur and oxygen, steels of the invention may contain 0.6 to 0.8% carbon, up to 0.50% silicon, 0.80 to 1.30% manganese and not more than 0.05% phosphorus, balance iron and impurities resulting from melting.

Steels with 0.5 or 0.55 to 0.75% carbon, 0.10 to 0.50% silicon, 1.30 to 1.70% manganese and not more than 0.05% phosphorus, balance iron and impurities arising from melting, are particularly suitable.

Further suitable steels are those with 0.60 to 0.80% carbon, 0.60 to 1.20% silicon, 0.80 to 1.30% manganese, not more than 0.30% phosphorus, and 0.70 to 1.20% chromium, balance iron and impurities arising from melting.

Steels that likewise also come into consideration for alloying with tellurium in accordance with the invention are steels with 0.70 to 0.80% carbon, 0.80 to 1.20% silicon, 0.80 to 1.30% manganese, not more than 0.030% phosphorus, 0.80 to 1.20% chromium, up to 0.25% titanium and/or vanadium, balance iron and impurities arising from melting. Preferably, however, steels are free from titanium, since the titanium carbide and carbon nitride impair the fatigue properties.

Finally, steels with 0.53 to 0.62% carbon, 0.65 to 1.1% manganese, 0.8 to 1.3% chromium, 0.1 to 0.6% silicon, 0.05 to 0.11% molybdenum, 0.05 to 0.11% vanadium and less than 0.02% phosphorus, balance iron and impurities arising from melting, are also suitable as tellurium-containing rail materials.

The rail steels set forth above with their analyzes may also contain 0.01 to 0.025% aluminum, preferably up to 0.004% aluminum.

Beside the favorable effect of the tellurium on the sulfides particular importance attaches to the low sulfur content, inasmuch as the wear resistance improves substantially with falling sulfur content. Since tellurium and sulfur act in the same direction, the steels of the invention could also be tellurium-free if the sulfur content is small enough.

To demonstrate the adverse effect of sulfur on the tensile strength in the transverse direction the sulfur content of a 900A grade rail steel was raised from the usual value of about 0.022% to 0.052%. The composition of the standard 900A steel is set forth in Table I below. The rails concerned were laid in a curve with a radius of 570 m. After a loading of about $92\times10^6$ tonnes the guide surface wear was measured: it amounted in the case of the 900A grade rails with the usual sulfur content to 3.5 mm and in the case of the 900A with the above-mentioned increase sulfur content to 6 mm.

TABLE I

| | C | Si | Mn | P | S | Al | Cr | Ni | Mo | Cu | N |
|---|---|---|---|---|---|---|---|---|---|---|---|
| 700 | 0.473 | 0.25 | 0.90 | 0.013 | 0.021 | 0.002 | 0.16 | 0.05 | 0.03 | 0.08 | 0.0062 |
| 800 | 0.541 | 0.16 | 1.07 | 0.011 | 0.002 | 0.002 | 0.09 | 0.04 | 0.03 | 0.07 | 0.0050 |
| 900A | 0.678 | 0.23 | 1.20 | 0.019 | 0.019 | 0.002 | 0.18 | 0.05 | 0.04 | 0.07 | 0.0050 |

(contents in %)

Figure 1:
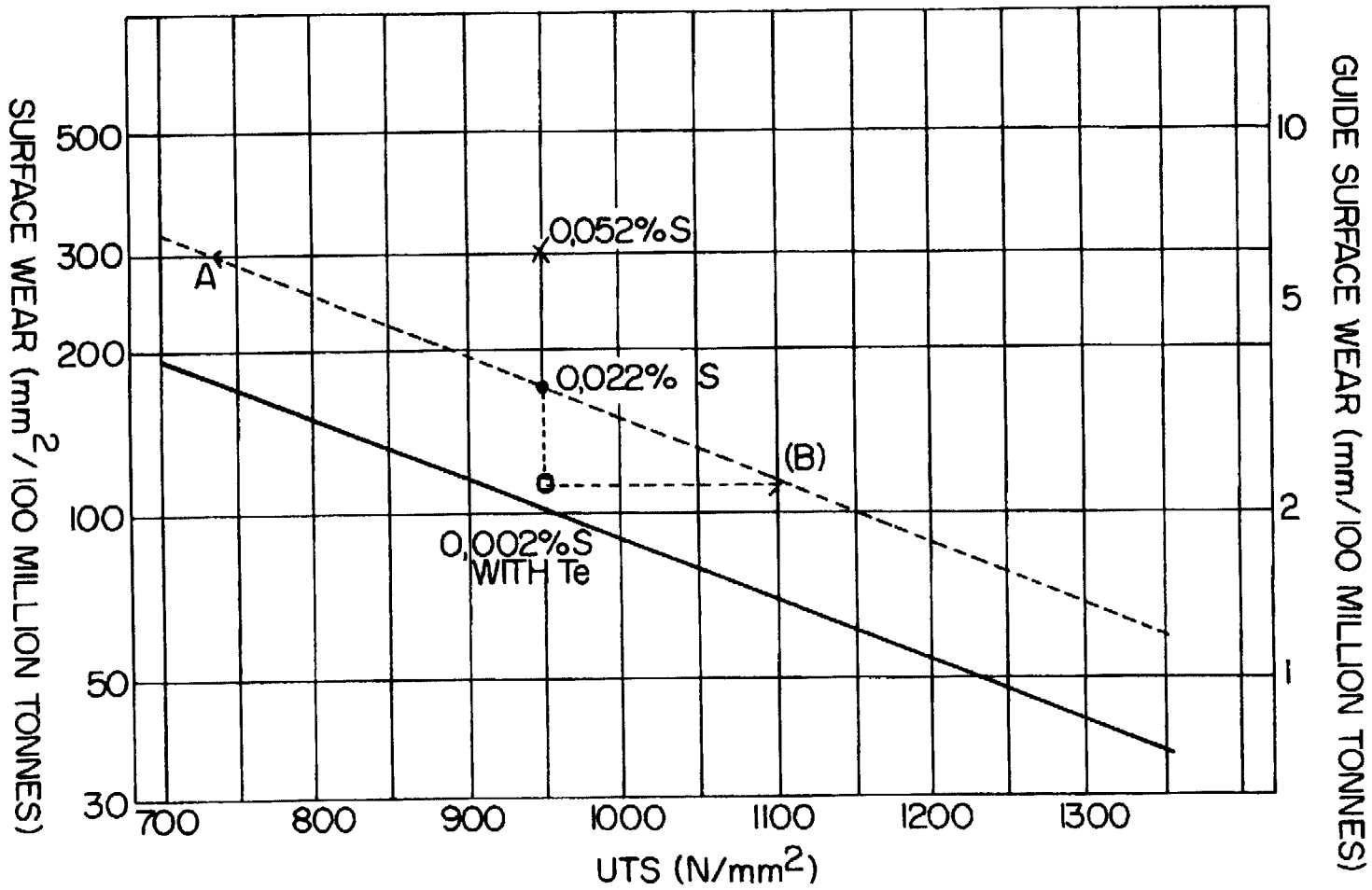
FIG. 1 is a graphical representation of the change in UTS ($N/mm^2$) v. surface wear ($mm^2$/100 million tonnes) resulting from an increase in the sulfur content of standard 900A grade rail steel from the usual value of 0.022% to 0.052% and a decrease in the sulfur content from 0.022% to 0.002% with the addition of tellurium according to the present invention.

The diagram of FIG. 1 of the accompanying drawings contains an evaluation of the test results. In it the bold arrow line and the point A show the dependence of curve wear on the tensile strength in the strength range of 700 to 1350 N/mm$^2$ for radii of 300 to 350 m, from previous tests. The point marked on the broken vertical line in the diagram of FIG. 1 is representative of the usual 900A rail steel, while the cross shows the position of the test steel with the sulfur content increased to 0.052%. The thin vertical line characterizes the wear of the above-mentioned test curve. This wear behavior corresponds to the 700 grade rail steel with its usual sulfur content.

Figure 2:
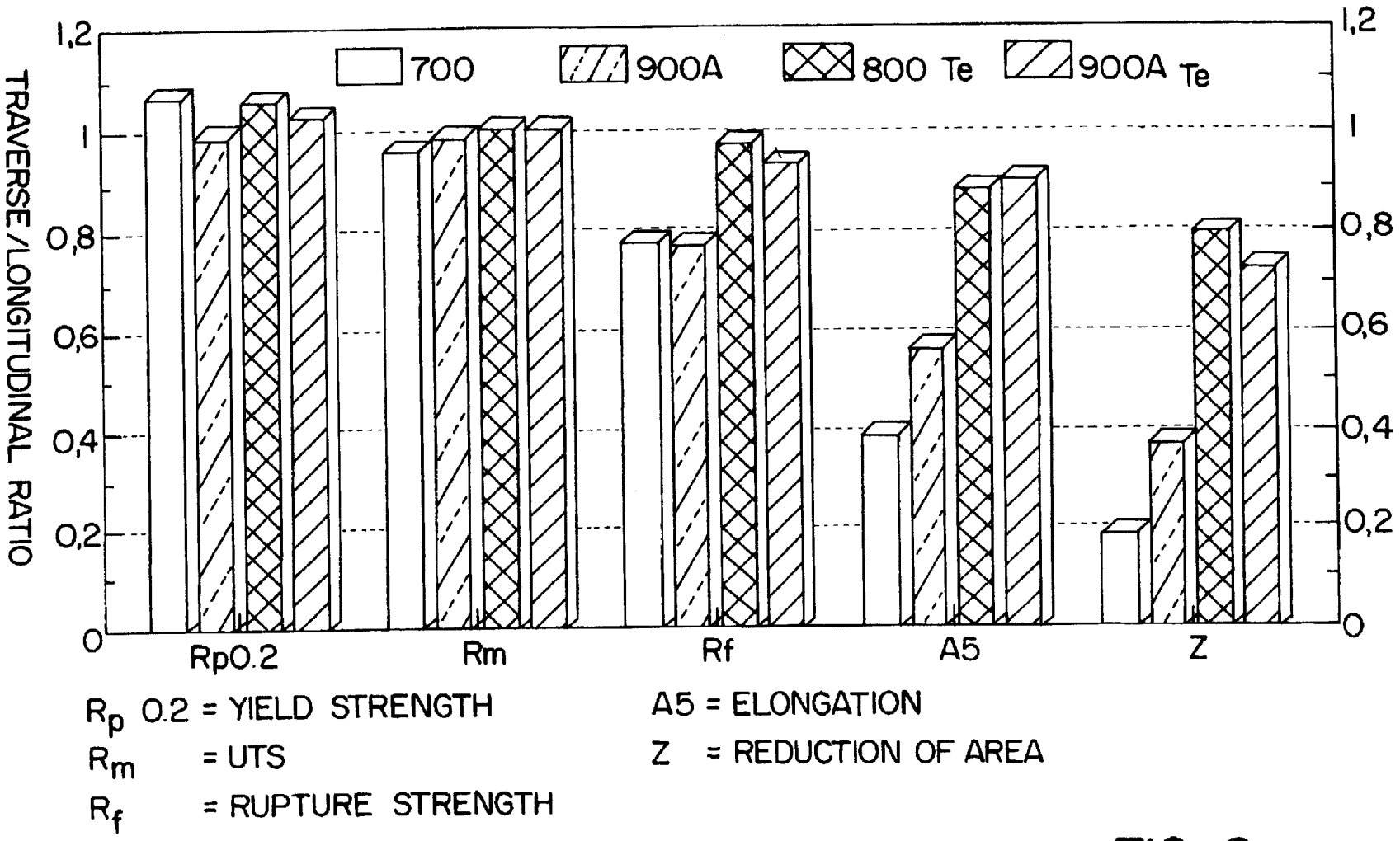
FIG. 2 is a graphical representation of yield strength, UTS, rupture strength, elongation and reduction of area measurements for standard 700 and 900A grade rail steel as compared to standard 800 and 900A grade rail steel containing tellurium according to the present invention.

In order now to demonstrate the favorable effect of small contents of tellurium, further tests were carried out using the conventional rail steel 900A, 900A with tellurium, 800 with tellurium and 700. In Table II below the properties of longitudinal and transverse specimens of the two tellurium-containing rail steels of the invention and of the two comparative steels are compared. A graphical representation of the respective ratios of the transverse to the longitudinal properties is given by the diagram of FIG. 2.

TABLE II

| | | Yield Strength $R_p$ (N/mm$^2$) | | UTS $R_m$ (N/mm$^2$) | | True rapture stress $R_f$ (N/mm$^2$) | | Elongation A5 (%) | | Reduction of area Z (%) | |
|---|---|---|---|---|---|---|---|---|---|---|---|
| Grade | | long.(l) | trans.(t) | long.(l) | trans.(t) | long.(l) | trans.(t) | long.(l) | trans.(t) | long.(l) | trans.(t) |
| 700 | min | 498 | 552 | 801 | 752 | 1203 | 942 | 19.2 | 7.0 | 36.6 | 6.6 |
| | max. | 577 | 589 | 846 | 796 | 1266 | 965 | 21.1 | 9.8 | 48.8 | 8.0 |
| | mean | 542 | 581 | 822 | 786 | 1223 | 950 | 20.5 | 8.0 | 41.1 | 7.8 |
| | t/l | 1.07 | | 0.96 | | 0.78 | | 0.39 | | 0.19 | |
| 800Te | min | 392 | 422 | 813 | 828 | 980 | 956 | 13.3 | 11.0 | 27.9 | 21.9 |
| | max. | 516 | 537 | 863 | 872 | 1247 | 1324 | 20.3 | 16.3 | 41.3 | 33.3 |
| | mean | 440 | 466 | 838 | 844 | 1105 | 1078 | 15.3 | 13.6 | 32.8 | 26.7 |
| | t/l | 1.06 | | 1.01 | | 0.98 | | 0.89 | | 0.81 | |
| 900A | min | 541 | 527 | 934 | 946 | 1245 | 1045 | 11.7 | 6.2 | 24.9 | 9.8 |
| | max. | 559 | 552 | 990 | 967 | 1429 | 1112 | 14.2 | 8.7 | 30.1 | 12.9 |
| | mean | 548 | 542 | 970 | 957 | 1366 | 1072 | 13.0 | 7.4 | 28.4 | 10.8 |
| | t/l | 0.99 | | 0.99 | | 0.78 | | 0.57 | | 0.38 | |
| 900A | min | 463 | 475 | 893 | 918 | 1072 | 1083 | 11.3 | 9.3 | 21.9 | 16.0 |
| Te | max. | 570 | 619 | 966 | 976 | 1393 | 1261 | 14.7 | 14.0 | 41.2 | 27.8 |
| | mean | 509 | 542 | 942 | 950 | 1240 | 1164 | 12.8 | 11.7 | 28.8 | 21.3 |
| | t/l | 1.03 | | 1.01 | | 0.94 | | 0.91 | | 0.74 | |

It is clear from these results that the addition of tellurium has practically no effect on the transverse tensile strength $R_m$ compared with the values in the longitudinal direction, while the transverse yield strength $R_p$ 0.2 is slightly increased. The ratio of the rupture strengths in the transverse and longitudinal directions is increased from 0.88 in the case of the tellurium free comparative steels to 0.95 in the case of the tellurium containing steels, while the corresponding ratio of the elongation at fracture in the case of the 900 grade steels is raised from 0.57 to 0.91 and that of the reduction in area at fracture from 0.38 to 0.74.

Overall it has been found in comparative tests that the wear resistance can be raised by 50% or more by means of the tellurium addition according to the invention. Thus in the case of the conventional 900A rail steel the specific surface wear in the case of a rail bend with a radius of 350 m was 200 $mm^2$ per $111\times10^6$ tons loading, while in the case of a tellurium containing steel of the invention it was only 120 $mm^2$.

Substantially better wear behavior is also obtained when the 900A steel is tellurium-free but contains only 0.003% sulfur. To this extent the object of the invention can also be achieved by restricting the sulfur content to below 0.007%, though not to the same degree as in a steel of the invention with up to 0.004% tellurium.

Table III below shows how the mechanical properties can be improved by restricting the sulfur content and in addition with a tellurium addition of only 0.002%. This shows up particularly in the transverse properties and in the elongation and reduction in area at fracture, which are of particular importance in view of the relatively high tensile strength.

TABLE III

| Steel | Sulfur content (%) | UTS ($N/mm^2$) long. | UTS ($N/mm^2$) trans. | True Rupture stress ($N/mm^2$) long. | True Rupture stress ($N/mm^2$) trans. | Elongation (%) long. | Elongation (%) trans. | Reduction in area (%) long. | Reduction in area (%) trans. |
|---|---|---|---|---|---|---|---|---|---|
| UCI 700 | 0.025 | 820 | 815 | 1200 | 870 | 20 | 8 | 40 | 12 |
| UCI 700 | 0.003 | 823 | 820 | 1240 | 1040 | 19.5 | 14.5 | 38 | 25 |
| UCI 700* | 0.003 + Te | 824 | 822 | 1250 | 1170 | 20 | 18.5 | 39 | 32 |
| UCI 900A | 0.024 | 980 | 975 | 1350 | 1120 | 13 | 7 | 25 | 10 |
| UCI 900A | 0.003 | 978 | 977 | 1348 | 1210 | 13.5 | 9 | 29 | 18 |
| UCI 900A* | 0.093 + Te | 976 | 975 | 1345 | 1315 | 14 | 12 | 29 | 24 |

*Tellurium addition of 0.002%

Beside tellurium the steel of the invention may also contain further elements with an affinity for sulfur, such as zirconium, calcium, magnesium and rare earth metals.

Altogether, the tests show that the wear resistance can be substantially increased without an increase in the tensile strength in the longitudinal direction. Combined with this is the advantage that the weldability and toughness are not impaired, for an increase in the strength for the purpose of improving the wear properties would have associated with it impaired weldability and toughness.

On the other hand, however, the strength can conversely be reduced while retaining the wear resistance, with the associated advantage of a smaller content of carbon and of alloying elements and associated improved weldability and resistance to fracture.

Independent of the two possible ways mentioned above of purposefully adjusting the properties of the steel according to the invention, the steel of the invention has in any event better transverse properties, in particular a better fracture strength, elongation and reduction in area at fracture and correspondingly a high resistance to longitudinal cracking. Added to this is an increase of some 20% in fatigue resistance in the transverse direction and the higher resistance to fatigue damage resulting therefrom, which could otherwise only be achieved by an increase of 20 $N/mm^2$ in the tensile strength.

That which is claimed is:

1. Steel for rails, check rails and railroad rolling components consisting of 0.5 to 0.75% carbon, 0.10 to 0.50% silicon, greater than 0.90 and up to 1.70% manganese, less than 0.025% aluminum, not more than 0.05% phosphorus, a tellurium content of less than 0.004%, and a sulfur content such that the tellurium/sulfur ratio is from 0.1 to 0.6, the balance being iron and impurities resulting from melting.

2. Steel for rails, check rails and railroad rolling components consisting of 0.53 to 0.62% carbon, greater than 0.90 and up to 1.1% manganese, less than 0.025% aluminum, 0.8 to 1.3% chromium, 0.1 to 0.6% silicon, from 0.05 to 0.11 each of molybdenum and vanadium, less than 0.02% phosphorus, a tellurium content of less than 0.004%, and a sulfur content such that the tellurium/sulfur ratio is from 0.1 to 0.6, the balance being iron and impurities resulting from melting.

3. Rails, check rails and railroad rolling components made from a steel comprising 0.5 to 0.75 % carbon, 0.10 to 0.50% silicon, greater than 0.90 and up to 1.70% manganese, not more than 0.05% phosphorus, a tellurium content of less than 0.004%, and a sulfur content such that the tellurium/sulfur ratio is from 0.1 to 0.6, the balance being iron and impurities resulting from melting.

4. Rails, check rails and railroad rolling components made from a steel comprising 0.53 to 0.62% carbon, 0.65 to 1.1% manganese, 0.8 to 1.3% chromium, 0.1 to 0.6% silicon, from 0.05 to 0.11% each of molybdenum and vanadium, less than 0.02% phosphorus, a tellurium content of less than 0.004% and a sulfur content such that the tellurium/sulfur ratio is from 0.1 to 0.6, the balance being iron and impurities resulting from melting.

5. A method of forming rails, check rails and railroad rolling components comprising:

providing a rolled steel with 0.5 to 0.75% carbon, 0.10 to 0.50% silicon, greater than 0.90 and up to 1.70% manganese, not more than 0.05% phosphorus, a tellurium content of less than 0.004%, and a sulfur content such that the tellurium/sulfur ratio is from 0.1 to 0.6, the balance being iron and impurities resulting from melting; and forming a rail, check rail, or railroad rolling component from the rolled steel without heat treatment.

6. A method of forming rails, check rails and railroad rolling components comprising:

providing a rolled steel with 0.53 to 0.62% carbon, 0.65 to 1.1% manganese, 0.8 to 1.3% chromium, 0.1 to 0.6% silicon, from 0.05 to 0.11% each of molybdenum and vanadium, less than 0.02% phosphorus, a tellurium content of less than 0.004%, and a sulfur content such that the tellurium/sulfur ratio is from 0.1 to 0.6, the balance being iron and impurities resulting from melting; and forming a rail, check rail, or railroad rolling component from the rolled steel without heat treatment.

7. Rails, check rails and railroad rolling components made from a steel comprising 0.5 to 0.75 % carbon, 0.10 to 0.50% silicon, greater than 0.90 and up to 1.70% manganese, not more than 0.05% phosphorus, 0.01 to 0.25% aluminum, a tellurium content of less than 0.004%, and a sulfur content such that the tellurium/sulfur ratio is from 0.1 to 0.6, the balance being iron and impurities resulting from melting.

8. Rails, check rails and railroad rolling components made from a steel comprising 0.53 to 0.62% carbon, 0.65 to 1.1% manganese, 0.8 to 1.3% chromium, 0.1 to 0.6% silicon, from 0.05 to 0.11% each of molybdenum and vanadium, less than 0.02% phosphorus, 0.01 to 0.25% aluminum, a tellurium content of less than 0.004%, and a sulfur content such that the tellurium/sulfur ratio is from 0.1 to 0.6, the balance being iron and impurities resulting from melting.

* * * * *

UNITED STATES PATENT AND TRADEMARK OFFICE

CERTIFICATE OF CORRECTION

PATENT NO. : 5,711,914

DATED : January 27, 1998

INVENTOR(S) : Heller

It is certified that error appears in the above-identified patent and that said Letters Patent is hereby corrected as shown below:

On the title page: Item

[73] Assignee: "Stahwerke" should be --Stahlwerke--.

Item [56]
Attorney, Agent, or Firm - after "Seltzer" delete ";".

Signed and Sealed this

Twenty-first Day of July, 1998

Bruce Lehman

*Attest:*

BRUCE LEHMAN

*Attesting Officer*

*Commissioner of Patents and Trademarks*